US006824369B2

(12) United States Patent
Raymond

(10) Patent No.: US 6,824,369 B2
(45) Date of Patent: Nov. 30, 2004

(54) ROTARY VARIABLE EXPANSIBLE CHAMBER-KINETIC HYBRID PUMP

(76) Inventor: Charles Dow Raymond, Box 6688, Lautoka (FJ)

( * ) Notice: Subject to any disclaimer, the term of this patent is extended or adjusted under 35 U.S.C. 154(b) by 199 days.

(21) Appl. No.: 10/279,799

(22) Filed: Oct. 25, 2002

(65) Prior Publication Data

US 2003/0091454 A1 May 15, 2003

Related U.S. Application Data

(63) Continuation-in-part of application No. 09/836,396, filed on Apr. 17, 2001.

(51) Int. Cl.[7] ..... F04C 2/344; F04C 15/04; F04D 29/40

(52) U.S. Cl. ..... 418/184; 418/31; 418/188; 418/241; 415/206; 415/211.1

(58) Field of Search ..... 418/29, 31, 184, 418/188, 241; 415/206, 211.1

(56) References Cited

U.S. PATENT DOCUMENTS

| | | | | | |
|---|---|---|---|---|---|
| 727,171 | A | | 5/1903 | Mayer | |
| 1,215,881 | A | * | 2/1917 | Siemen | 415/206 |
| 1,287,920 | A | * | 12/1918 | Duda | 415/206 |
| 2,068,570 | A | | 1/1937 | Ross | |
| 2,096,074 | A | | 10/1937 | Stevens | |
| 2,784,557 | A | | 3/1957 | Badalini | |
| 2,982,224 | A | * | 5/1961 | Williams | 415/211.1 |
| 3,050,012 | A | * | 8/1962 | Biermann | 418/188 |
| 3,191,541 | A | | 6/1965 | Browen | |
| 3,361,076 | A | * | 1/1968 | Davis | 418/31 |
| 3,560,106 | A | * | 2/1971 | Sahlstrom | 415/206 |
| 5,440,926 | A | | 8/1995 | Lew et al. | |
| 5,733,113 | A | * | 3/1998 | Grupping | 418/188 |
| 5,964,584 | A | * | 10/1999 | Lorentz | 418/188 |

FOREIGN PATENT DOCUMENTS

| | | | |
|---|---|---|---|
| FR | 541344 | 5/1922 | |
| FR | 691485 | 7/1930 | |
| GB | 20816 | 10/1891 | |
| GB | 341874 | * 1/1931 | 418/188 |
| IT | 288626 | 9/1931 | |

* cited by examiner

*Primary Examiner*—John J. Vrablik

(57) ABSTRACT

This invention concerns pumping fluids to both high pressures and high flow rates and thus has a very high power density. The technology pertains to both fluid power and to fluid transfer and is adaptable to a wide scope of use. The concept is a very simple rotary variable displacement expansible chamber pump which can also be a rotary kinetic pump and thus is a hybrid. At a positive displacement setting, the pump primes by positive displacement, then as the rotational speed increases; the pump gains a kinetic pumping component, then as head pressure increases the pump again becomes positive displacement. At a zero displacement setting, the pump is purely a rotary kinetic pump. The variable displacement feature allows both performance and efficiency. The porting allows very high rotational speeds and flow rates near to centrifugal designs. When set at zero displacement, the device has features both of positive displacement fan (gear pump) and kinetic (centrifugal pump). The pump is vibration free and silent. Fields of use are fluid power, where the power density is higher, and fluid transfer where high flow rates at higher pressures are required. The concept marries rotary positive displacement to rotary kinetic in pumps.

23 Claims, 5 Drawing Sheets section bb section aa

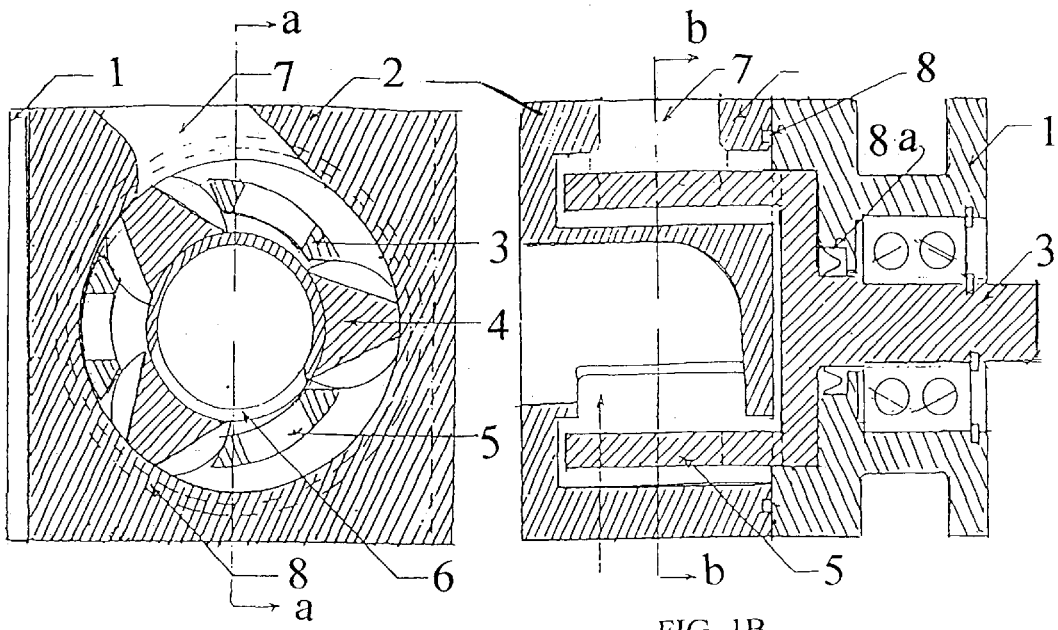
FIG 1A
section bb
FIG 1B
section aa
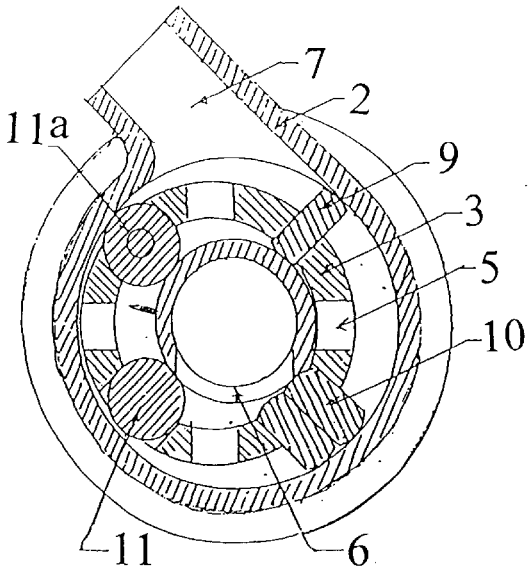
FIG 2A
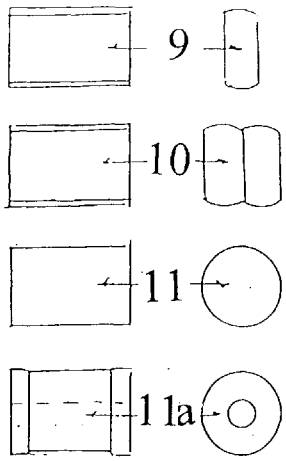
FIG 2B section bb section aa section bb section aa section bb section aa section bb section aa section bb section aa

ROTARY VARIABLE EXPANSIBLE CHAMBER-KINETIC HYBRID PUMP

This invention is a continuation-in-part of U.S. patent application Ser. No. 09/836,396, filed Apr. 17, 2001 entitled "Rotary Two Axis Expansible Pump with Pivotal Link" and PCT application No. PCT/US02/08265 with the same title.

SUMMARY

A variable displacement expansible chamber pump has an inlet through the center chamber axis, similar to a centrifugal pump. The pump has abutments which divide a chamber which may be annular cylindrical in shape and the abutments are driven by a rotor on a different but a parallel axis, causing the sub-chambers between adjacent abutments to expand or contract. The chambers are exposed either to the intake or discharge but not both simultaneously.

The resultant pump is one having both a positive displacement pumping action as well as a kinetic pumping action. Since the device is variable displacement, zero displacement is one setting. At zero displacement the pump is a purely kinetic device. Thus at all displacement settings, the pump will have two distinct pumping disciplines.

Because the pump marries positive displacement to kinetic pumping, the flow rate is considerably increased by two means: the superimposed kinetic pumping, and the centrifugal supercharging of the expansible chambers, which allow greater rotational speeds to be attained at higher flow rates.

In fluid power applications, the increased flow rates mean increased power.

In fluid transfer applications the flow rates approach those of centrifugal devices while allowing the pressure capability of positive displacement.

The variable displacement provides versatile performance and increased efficiency.

The design is simple; of low cost of manufacture; and is silent and free of vibration.

BACKGROUND OF THE INVENTION

The fields of endeavor of this invention are: fluid power, fluid (liquid) transfer, gas compressor-expander, vacuum pump.

That application was classified under art unit 3748; however, some embodiments in that case also showed characteristics not usually found in that art group. Those embodiments showed not only a positive displacement pumping ability, but also a rotary kinetic component, which when the displacement was set at zero was the only component and it was apparent from the pressure flow curves that there are two distinct curves which unite to form a single resultant curve. It was apparent from those curves that not only did the kinetic flow add to the total flow, but it also considerably extended the rotational speed of the positive displacement and thereby increased both flow and power. This application is to extend and concentrate on the hybrid nature of this technology and therefore will not only be described by art group 3748, but also have characteristics of class 415, however; class 415 specifically excludes expansible chamber pumps. This variable expansible chamber concept, when set at zero displacement, pumps purely by kinetic means, however, the intake and discharge still do not communicate which sets the device apart from other rotary kinetic pumps. In this pumping action, the momentum of the fluid carries fluid out of the discharge port and creates a partial vacuum within the chamber. The vacuum then fills as the chamber passes the intake port. At all displacement settings, there will be two distinct pumping actions, the positive displacement, and the kinetic. The higher the rotational speed, the larger the kinetic component. The higher the head pressure, the greater the positive displacement component.

This art then embraces both positive displacement pumps and rotary kinetics pump art.

Positive displacement pumps are generally regarded as high pressure, low flow devices, while centrifugal pumps are generally the opposite, having high flow rates but less pressure capability.

This hybrid pump tends to merge the two disciplines by increasing the flow of the positive displacement and at the same time maintaining the pressure capability and also allowing some high kinetic flow rates. Thus, this technology allows greater power as a result of flow times pressure. This becomes especially apparent in fluid power applications where pressures may equal the available hydraulic pumps, but flow rates may be increased by a factor of two or three and hence power is increased by the same factor. This could change fluid power applications from being auxiliary drives to being prime mover drives. In the case of fluid transfer, the technology will improve efficiency above head pressures of 25 psi, or so, as well as providing self priming and while providing high flow rates.

PRIOR ART

Prior art such as in vane pumps, shows porting which is inferior due to cavitation problems. To put the intake on the outer chamber surface causes cavitation and requires reduced angular velocity. In the case of a vane pump, the centrifugal force encountered in the suction port subtracts from the efficiency, whereas in this concept, it adds.

The general aspect of the circular chambers and simple abutments, make this a simple and high speed pump.

This pump has better suction, higher rotational speeds, greater flow rates, and more versatile performance and efficiency than existing positive displacement pumps, and as a hybrid has better performance than the smaller centrifugal pumps.

OBJECTS

A first object is to provide a variable displacement expansible pump having an intake at the center axis and a discharge at the radially outward surface to provide the pump with a kinetic pumping component which adds to the expansible component.

A second object is to provide a pump which primes as a positive displacement, becomes largely a kinetic pump when the pump reaches the desired rotation speed, then which returns to being a positive displacement as head pressure is increased.

A third object is to provide a variable pump in which a displacement is chosen which determines a specific displacement curve; and a rotational operational speed is chosen which described a specific kinetic pumping curve; such that the resultant curve approaches an hyperbola in which the drive torque is nearly constant for most of the curve regardless of either flow or pressure.

A fourth object is to provide a pump with flexible vanes which will pass debris.

A fifth object is to provide a self priming pump which is only positive displacement in pumping a gas (air), but then becomes a kinetic pump when the pump reaches operational speed and liquid enters the pump.

A sixth object is to provide a hinged vane vacuum pump, compressor, or engine which is pressure regulated variable displacement and can have constant torque, hence higher efficiency.

A seventh object is to provide a simple pump which is similar to the variable displacement pump set at zero displacement in which the moveable abutments are removed but the porting remains the same and the pump operates as a rotary valved kinetic pump where the discharge does not communicate with the intake, but the fluid is captured within sub-chambers much as in a gear pump and the discharge is at rotor velocity.

An eighth object is to provide a simple pump as in the seventh object in which the fluid is captured in fixed chambers by centrifugal force and the discharge is tangential at rotor velocity since the pump does not have a volute.

ADVANTAGES

A first advantage is a positive displacement pump with increased capacity. This is especially an advantage for fluid power applications where doubling the flow rate will double the power output.

A second advantage is in fluid transfer where the pump has flow rates approaching centrifugal rates, but is able to reach high head pressures.

A third advantage is that the regulated variable displacement can match pump load to drive load regardless of varying head pressure.

A fourth advantage is a self priming pump which after priming may be either a kinetic or positive displacement pump.

A fifth advantage is to have a kinetic pump with suction and discharge which do not communicate and is easy to prime.

A sixth advantage is to have a variable compression pump as compressor or expander in order to match to drive torque.

IN THE DRAWINGS

1 refers to a first housing member which has a rotor mounted for rotation.
2 refers to a second housing member having a chamber that is approximately annular and having a central hub.
3 refers to the rotor shaft element.
4 refers to the abutment which seals and divides the chamber.
5 refers to a fluid passage slot in the rotor drive fingers.
6 refers to the intake passage and port through the center hub in housing 2.
7 refers to the discharge passage through housing 2.
8 refers to an O-ring seal between housing 1 and housing 2.
8*a* refers to a seal between housing 1 and rotor shaft 3.
9 refers to a double vane abutment.
10 refers to a double vane abutment.
11 refers to a roller type abutment
11*a* refers to a roller type abutment designed to separate the pressure loaded surfaces and reduce spin.
12 refers to a flexible abutment having two flex surfaces.
13 refers to a pin attached to the flexible abutment 12 which is held for rotation by rotor 3
14 refers to a flexible abutment bonded to rotor element 3
15 refers to an annular groove in both housing 1 and housing 2 which engages flexible abutment 14.
16 refers to a hinged abutment which is free to rotate about the center hub.
17 refers to a swivel bearing element.
18 refers to an assembly consisting of an adjusting screw through housing 1 which contacts a spring which in turn contacts housing 2.

BRIEF DESCRIPTION OF THE DRAWINGS

FIGS. 1A and 1B show a variable displacement pump or motor in which the low pressure port is through the center chamber axis and the high pressure port is through the outer chamber surface. FIG. 1A is a sectional view through the housing and working chamber. FIG. 1B is a sectional side view.

FIGS. 2A and 2B show the pump or motor with four other abutment types. FIG. 2A is sectional view through the working chamber, similar to 1A. FIG. 2B shows four abutment types in front and side views.

FIG. 3A is a sectional view through the working chamber and FIG. 3B is a sectional side view.

FIG. 5B is a sectional side view inward of the dashed line is a partial vacuum in the two upper chambers.

SPECIFICATION

Figure 3A:
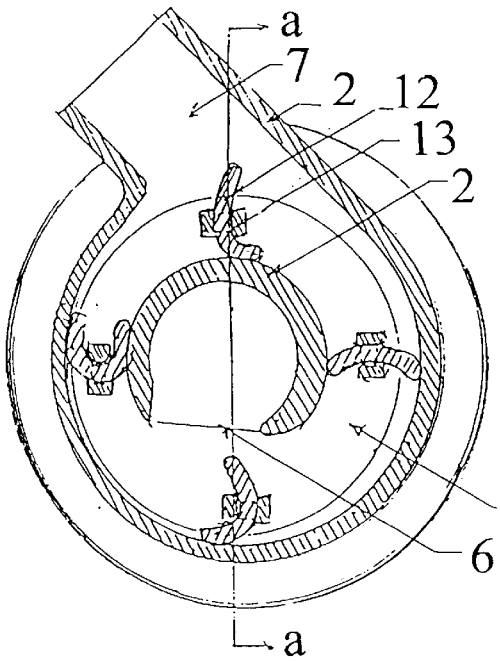
FIGS. 3A and 3B show a fixed displacement pump having center inlet and radially outward discharge as a flexible vane pump.

FIG. 1 shows a pump which is variable displacement and consist of a housing (1) in which a rotor (3) rotates. Housing (1) has a planar face and rotor (3) has a coplanar face with housing (1). Rotor (3) has three extending carousel type fingers which have radial slots. The radial slots engage three abutments (4). The abutments (4) rotate about a circular cylindrically shaped annular groove in a second housing (2) and the abutments divide the groove chamber in housing (2) into sub-chambers.

The inner hub portion of the housing (2) has a port entering housing (2) axially on the chamber center axis and has a port extending radially outward through the hub wall to communicate with a sector of the annular chamber of housing (2). Housing (2) has a planar face to fit in a sealing manner but to allow it to shift in order to vary displacement. The three abutments (4) seal and divide the annular chamber and are driven around the annular chamber by the rotor fingers with slits which engage the abutments. The rotor (3) fingers which extend nearly across the annular chamber have slots (5) which allows fluid to freely communicate between the inner hub surface and the outer chamber surface. The abutments (4) also are slotted to allow fluid to communicate from the inner hub surface to the outer chamber surface. The abutments (4) also have cylindrical surfaces to fit the rotor (3) finger slots, allowing the abutments to both slide radially outward in the radial rotor (3) slots but also to pivot while sliding. This surface can also have pivot bearing members (17) as in FIG. 6A.

In FIG. 1A, the rotor moving in a counter clockwise direction will cause fluid to be drawn in at the intake (6) and discharge at (7). The pump is shown at its maximum displacement position. The fluid can be pumped in two distinct manners in this pump. At lower rotational speeds, the pumping is primarily by positive displacement and the capacity can be calculated by the displacement per revolution times the number of revolutions per minutes. Thus, mathematically, flow=displacement×rpm. Since the displacement is variable, then there are two variables to determine the flow rate: the displacement setting and the rpm chosen.

However, as the rotation speed is increased, another pumping discipline emerges. That is pumping by velocity or centrifugal force. The slots in the rotor (3) fingers as well as the slot in the abutments (4) allow communication between the inner hub surface and the outer chamber surface. This allows the fluid to be drawn in at (6) and be thrown outward toward the outer chamber surface. In looking at FIG. 1A, fluid is being drawn in at (6) from the center hub where it is passing outward through slot (5) in rotor (3) as well as through the two slots in the two abutments. At the top of FIG. 1A the fluid is being thrown out through port (7) by two means: the two abutments are contracting the volume contained between them, and also the fluid is being thrown out centrifugally by momentum. If the rotational speed is high, the momentum is great; and if the head pressure at (7) is less than the force of fluid momentum, more fluid will exit through (7) than is displaced by positive displacement. The momentum of the velocity flow varies as the square of the rotational velocity. Thus, the pressure volume curve of this pump has two distinct components: the component of rpm× displacement and the component of rpm squared. The resultant curve is somewhat hyperbolic in nature. FIG. 1B shows how the fluid may be thrown radially outward through slots (5) and the slots in the abutments. If the displacement is set at the maximum and the rpm is low or the head pressure is high, the pump behaves as a positive displacement. If the displacement is set at zero, the pump behaves as a kinetic pump using centrifugal force, provided the rotational speed is high. For example, this pump having a 6 cu in/revolution maximum displacement run at 3600 rpm gives the following results through a 1.25 inch diameter discharge hose: at full displacement 100 usgpm; at 4 cubic inches/revolution displacement, 95 gpm; at zero displacement 72 gpm. Thus at full displacement only 5% of the flow was due to velocity. At ⅔ displacement, more than ⅓ flow was due to velocity. At no displacement, all flow was due to velocity.

In FIG. 2, the pump is shown with different abutment types. Four types are shown. The abutment shown as (9) is similar to a vane in some respects. The slot through the rotor (3) fingers is narrower in order to hold the vane. The vane must be wide enough so that a line drawn through the vane which is drawn radially outward from the chamber center axis must pass through the vane at all points perpendicular to the chamber walls. The abutments in (10) are double vanes in a single slot and each vane must meet the same criteria as (9) in order to seal. The abutments in (11) are cylindrical rollers. The specific gravity of the rollers make a difference in the radial direction of the force exerted on the abutment, whether centrifugal or centripetal. If the specific gravity is less than that of the pumped fluid, the force on the rollers is inward. If it is greater, the force outward. It is some advantage to have the rollers favor the inner lower speed surface (of the center hub). There is an inherent problem with rollers in a pump; that the spin caused by touching a high speed surface tends to move the rollers toward that surface which causes wear. The opposite is true for a motor.

The cylindrical rollers in 11(*a*) are divided into three parts, connected by a center shaft. This is to counter the problem of spin. In FIGS. 2B–11*a*, the center roller portion rides in the center radial rotor (3) slot and hence takes the torque load; while the two end rollers ride on the chamber arcuate surface. The surfaces mentioned must be relieved accordingly, to be tolerance, rather than contact seals.

In both FIG. 1 and FIG. 2, the housing (2) has an annular chamber which has a constant cross-section. Both can be variable displacement simply by shifting the axes of housing (1) and housing (2) relatively. Both have fluid entering through the chamber axis and being discharged through the chamber periphery.

Figure 3B:
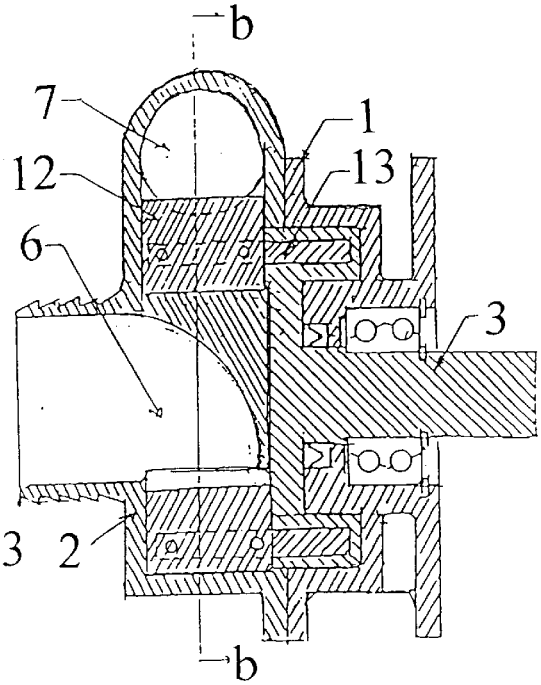

FIG. 3A shows a similar porting but is generally a fixed displacement. In FIG. 3A, the axis of the center hub is different from the axis of the outer chamber surface. The drive rotor is on a still different axis so that there are three axes involved. The chamber does not have constant cross-sectional width but does have constant depth as seen in FIG. 3B. Rotor (3) has projections (13) with flexible vanes (12) attached. This is different from other flexible vane pumps, not only in porting, but also with now the vane flexes at both inner and outer contacts with chamber walls, which are the outer surface and the inner hub. This is good for three reasons; first that in order to get displacement the flexing vane only has to flex half as far as on that flexes against a single surface; second, that the arrangement allows much more debris to be able to pass through the pump; and third because the geometry allows some centrifugal or velocity pumping as the pump reaches speed. For many uses, such as marine bilge pump, this is ideal, since the pump starts as a positive displacement which self primes, then changes to a centrifugal aided by positive displacement.

Figure 4A:
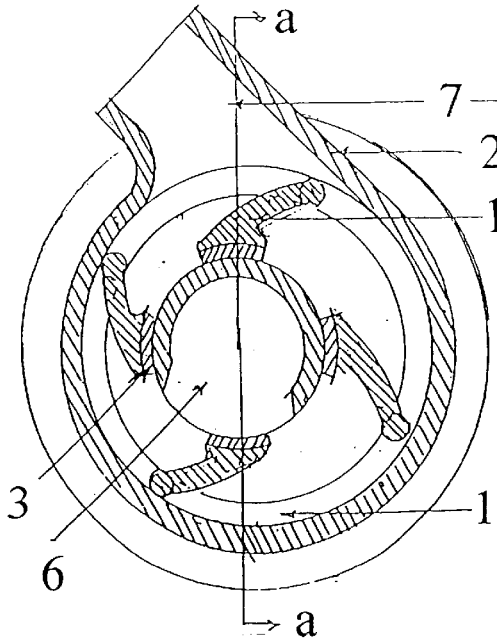
FIG. 4A shows another flexible vane pump with intake at the chamber center axis and discharge through the radially outward chamber surface.
Figure 4B:
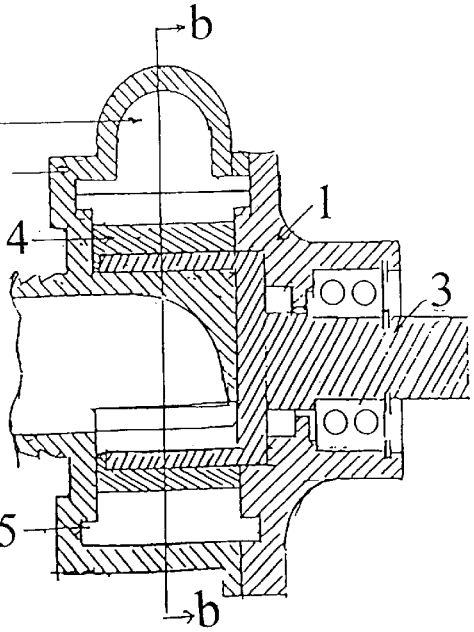
FIG. 4B is a sectional side view.

FIG. 4A shows a different flexing vane pump. The flexible vanes (14) are attached to the rotor (3) fingers and are also held in outer orbit by groove which mates with projections on flex vanes (14) to assure positive displacement. The rotor projections could also be pins in which case the vanes could be rigid and pivot on journals on the pins. The pump will also work without the slots (15) since the vanes will seal outward by centrifugal force as the pump reaches rpm. FIG. 4B is a typical sectional side view.

Figure 5A:
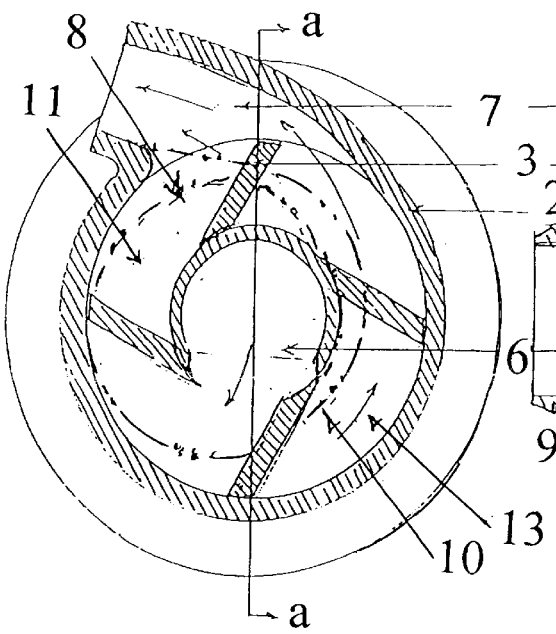
FIG. 5A shows a fixed displacement pump which is similar to FIGS. 1–4 where the displacement is made to be zero.
Figure 5B:
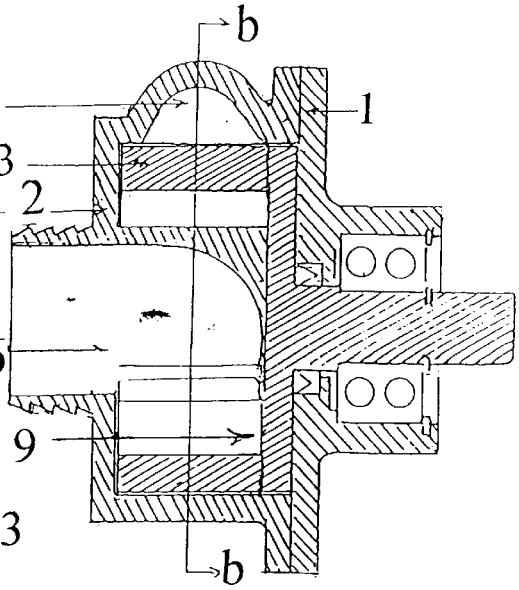
FIG. 5B is a sectional view through the working chamber.

FIG. 5A is similar to FIG. 1A and FIG. 2A in that housing (2) has an annular chamber of constant width and depth. It is similar in that FIG. 5A is FIG. 1A or FIG. 2A without abutments. Since FIG. 1A or FIG. 1B can run at zero displacement, then abutments are not required for such operation. FIG. 5 is then purely a velocity pump, but quite different from common centrifugal pumps in that there is no volute, and that the intake does not communicate with the discharge. This pump will self prime better than centrifugal pumps. In operation, the fluid is drawn in at 6 where it is thrown out centrifugally. The fluid is caused to reach tangential rotor velocity since the fluid is captured between the rotor (3) fingers which are like fixed vanes. As the vanes pass the discharge port (7), the fluid continues tangentially by momentum out the discharge duct. At the same time, a vacuum is forming on the inward part of the chamber with the approximate boundary shown by a dotted line in the chambers communicating with the discharge port. As the chamber having a vacuum passes the intake port, the fluid is drawn into the void. We might expect the pump to vibrate and thus require two intake ports and two discharge ports but no vibration has been noted. This is a very simple pump and one which will pass debris. FIG. 5B is a typical sectional side view.

The abutments (3) are vanes (also described as rotor fingers) (3) and rigidly fastened to the rotor face 9. The vane abutments (3), then above a rigidly fixed sealing surface to the rotor face, describing one sub-chamber boundary, the vane abutment (3) planar surfaces providing another sub-chamber boundary, the planar surface of the chamber providing another sub-chamber boundary, and the two arcuate chamber surfaces providing the other two sub-chamber boundaries, such that the sealing is entirely by tolerance except for the fixed seal.

In FIG. 5*a*, I have shown two phantom lines, which describe two important isograms, which are momentum isograms, as well as being isobars in the sub-chamber, to show the function. Isogram (8) shows that some fluid may not be discharged through the discharge port (7) by momentum, but could be carried around the chamber again. It also shows the creation of a vacuum space (11), as the momentum carries the contained fluid outward through the discharge port (7).

Note that isogram (8), during the existence of the sub-chamber on the pressure side is a planar surface coincident with the arcurate inner chamber surface of housing (2). Isogram (10) shows the inner limit of the fluid, which will be ejected by momentum through tangential discharge port (7).

The axially inward portion of the abutment vanes (3) has an angle that is close to tangential to the inner acurate chamber surface of housing member (2).

As the vanes are rotated, these vane edges provide heading edges of an inclined plane, which cuts into the fluid entering radially from intake (6). The inclined plane moves the fluid radially outward, much as in a centrifugal fan, but in this case moves the fluid into an enclosed sub-chamber (13) rather than through the pump into a volute. In this way, the fluid is able to be contained and acquire additional energy through reaching rotor velocity. At the discharge (7) the abutment vanes (3) are nearly perpendicular to the tangential discharge, which is ideal.

It is to be noted that the sub-chamber shape is such that most of the volume is near the axially outer chamber surface. This is also where the fluid has the highest energy. While the planar vanes in 5(*a*) are representative of the concept, it would be simple to make vanes that amplify the advantages mentioned; i.e. that the most volume be radially outward, and that the vane be nearly perpendicular at the axially outer end. FIG. 5*a* is similar to FIGS. 3*a* and 4*a* with annular chambers, and it is similar to FIGS. 1*a*, 2*a*, 2*b* (9–10) set at zero displacement.

Figure 5C:
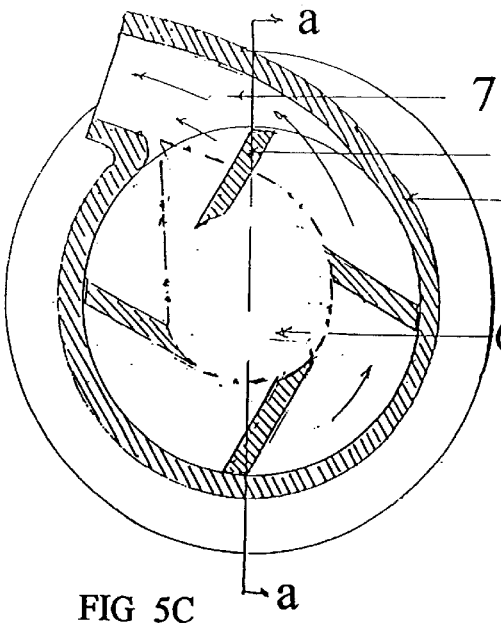
FIG. 5C is a modification of FIG. 5A.
Figure 5D:
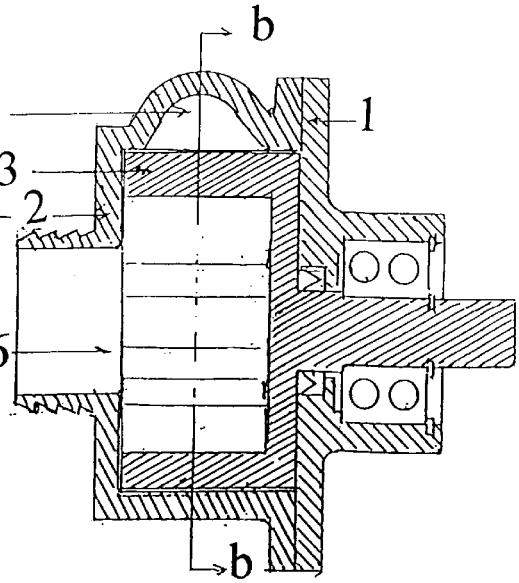
FIG. 5D is a sectional view through FIG. 5C.

FIG. 5C shows FIG. 5*a* with the center hub removed. The center hub portion in FIG. 5A held the fluid enclosed in a chamber between vane abutments. In FIG. 5C the fluid is held in the same way by centrifugal force and the fluid is still captured between the vanes unlike in a centrifugal pump where the fluid always is in radial outward motion. By being captured, the fluid attains the rotor velocity, which it cannot do in a centrifugal pump. Since the head pressure in a kinetic pump is proportional to the square of the discharge velocity, this pump will have much higher available head pressure. FIG. 5D is a sectional side view of 5C.

FIG. 5*c* has the same first housing member as shown in FIGS. 1*a*, 2*a*, 3*a*, 4*a*, 5*a*, and FIG. 6*a*. In FIG. 5*c*, the intake port has been enlarged to be 360 degrees, so the axially inner hub with the axially inner chamber surface has been removed from housing member (2), otherwise, housing member (2) is the same as in the figures listed for housing (1). The abutments (3) are the same as described in the description of FIG. 5*a*. In FIG. 5*a*, the axially inner arcuate surface of housing member (2) has been replaced by an isobar, indicated by the phantom line (10), which is an imaginary line defining a real boundary. This boundary is similar to the upper boundary of a full bucket of water, which does not require a lid in order to define the upper surface. The isobar defines the axially inner surface of the sub-chamber (13) to be the same as if the solid surface was still in place. The isobar, formed by the divergent force field (centrifugal force), also becomes a momentum isogram when not contained, and shows the approximate flow path of the fluid, as well a pressure gradient. In operation, it is essential that the fluid be contained within the sub-chamber (13) prior to reaching the discharge port (7), in order to gain energy by the positive displacement mode shown. It is then possible to have two tangential ports in housing member (2) if there are four sub-chambers, as shown in FIG. 5*a*, with two spaces in the chamber of housing member (2) reserved for two sub-chambers, and two spaces for tangential discharge ports (7).

As the sub-chamber ceases to exist, due to passing port (7), the isogram becomes nearly tangential in direction, and is very similar to a changing surface in an expansible chamber, also causing the fluid to be expelled through the port. This is very similar to an expansible chamber sliding or pivoting vane pump, which has two sub-chamber boundaries dependent upon centrifugal force through intermediate sliding vanes, while FIG. 5*c* has only one surface dependent upon centrifugal force.

Figure 6A:
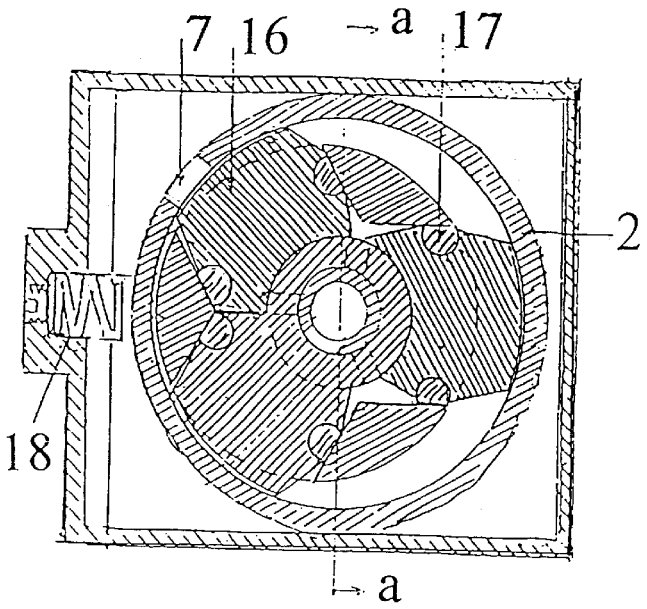
FIG. 6A shows a variable displacement compressor, expander, or vacuum pump having vanes hinged on a center hub through which the fluid intakes.

While FIG. 6*a* represents almost totally expansible chamber pumping, the FIGS. 1*a*, 2*a*, 3*a*, and 4*a* show a sharing between expansible chamber and positive displacement, FIG. 5*a* and 5*c* show the other end of the spectrum, being positive displacement pumping.

Figure 6B:
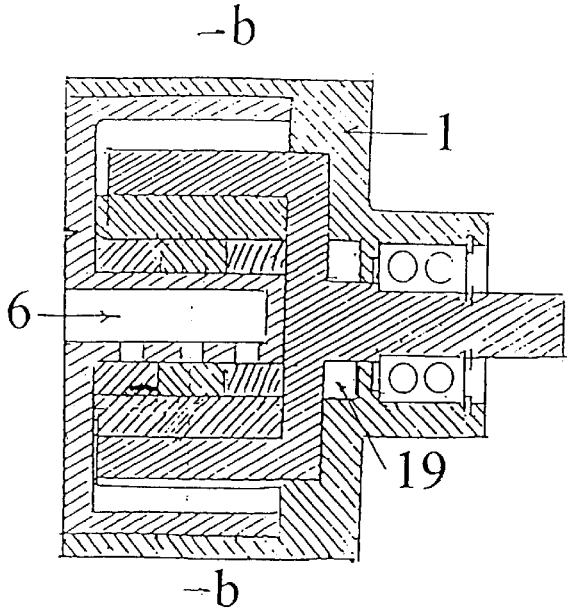
FIG. 6B is a sectional side view. The discharge is shown through the outer surface, but can be through the planar end surface.

FIG. 6 is similar to FIG. 1 and FIG. 2 except that the abutments are hinged on the center hub which allows high speed tolerance sealing. FIG. 6 is a vacuum pump, compressor, expander or engine in which, as in FIG. 1 and FIG. 2 the intake is through the center hub, the bearings are cooled, and, in case that the pump is used as an engine, the bearings can be cooled and lubricated by the incoming fuel. The air is drawn in at (6) compressed between the abutments, and discharged at (7). The discharge (7) is shown to be through the outer chamber wall but also can be through the housing (2) end wall near the arrow shown as (2) on FIG. 6B. This allows lubricant to stay within the pump for uses as vacuum pump or compressor. This is a variable displacement pump; and shown is a spring and adjust screw which acts against the pressure of compression such that the device can have a nearly constant torque over a larger pressure or vacuum range and thus be efficient. Note that in the position shown in FIG. 6A, the displacement is set at a maximum position and the compression ration is high. As a vacuum pump, at start up, the compression will force the spring to compress and the device to go to a lower compression ratio. As vacuum occurs in the pumped chamber communicating with port (6), the spring causes the displacement to increase.

Figure 7:
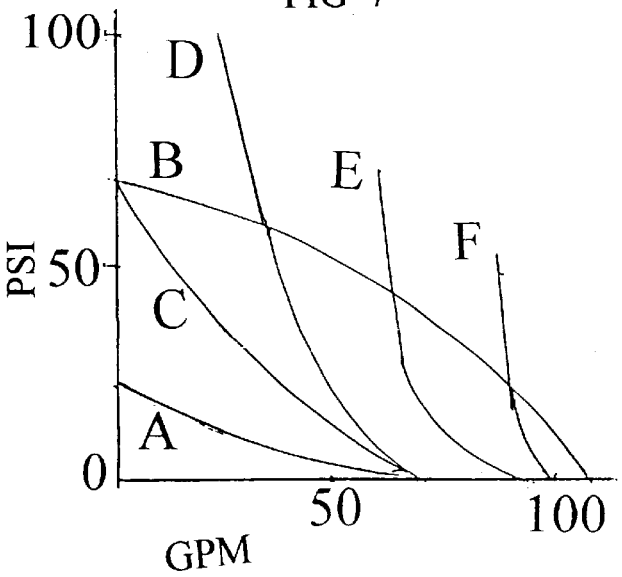
FIG. 7 shows comparison between the FIG. 1 pump and two commercial pumps in Pressure volume curves.

FIG. 7 shows comparisons with the elected species in FIG. 1 with two commercial pumps. All three pumps are close coupled to a 5 HP gasoline engine. Curve A shows the pressure flow curve of a diaphragm pump. The diaphragm pump has good self priming ability but low flow and low pressure capability. Curve B shows a single stage "high pressure" centrifugal pump which has good flow rates but marginal pressure and it is not good for self priming. Curve C shows the variable pump with displacement set at zero and shown no advantage over curve B. Curve D shows the variable pump set a 2 cubic inch/rev displacement and shows better efficiency at higher pressures. Curve E shows the displacement at 4 cubic inch/rev and shows better efficiency at higher head pressures. Curve F shows the variable pump at full displacement of 6 cubic inch/rev and shows quite good flow and much better pressure, hence efficiency. Generally, it shows that the variable pump is less efficient than the centrifugal at pressures from zero to about 25 psi, but thereafter more efficient.

Figure 8:
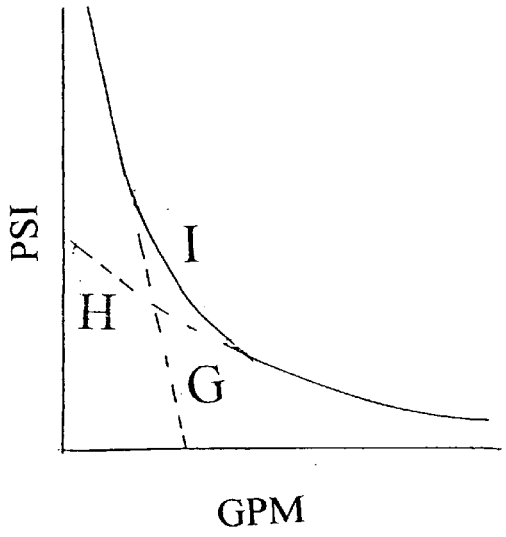
FIG. 8 shows how the displacement and rpm may be set to get a pressure volume curve which is hyperbolic in nature.

FIG. 8 shows the variable pump maybe set to provide a curve which is hyperbolic in nature. Curve H shows the velocity or momentum pumping curve. Curve G shows the positive displacement curve. Curve I shows the resultant curve. The value of a curve like this is that the flow times pressure in nearly constant over the entire curve, except at either end. This is important for drive motor efficiency.

Figure 9:
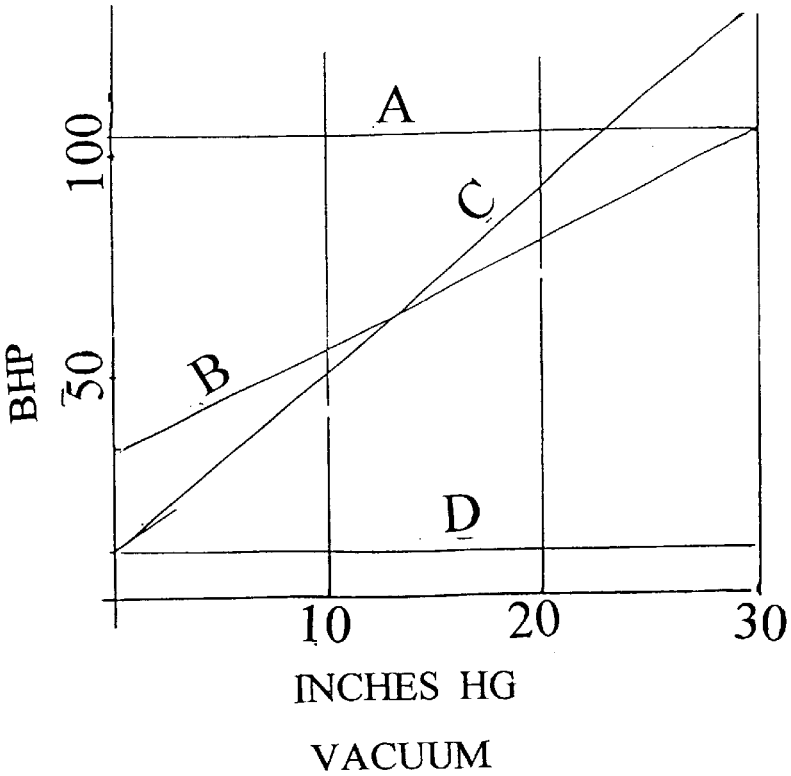
FIG. 9 shows a calculated comparison in power requirement between the vacuum pump in FIG. 6 and a Roots lobe pump.

FIG. 9 shows a comparison of the pressure regulated vacuum pump (shown in FIG. 6) with a commercial Roots blower lobe vacuum pump.

The variable pump is shown to have the same displacement at maximum swept volume as the Roots lobe pump; however the variable drops displacement as vacuum decreases. (A) is the swept volume of the Roots Lobe pump which is a constant with constant rpm. B shows the swept volume with the pressure controlled variable displacement pump. C shows the required brake HP with the Roots Vacuum pump and D shows the HP requirement of the variable pump which adjusts to a constant torque. The ratios of the power requirements of the comparisons is dramatic, showing the variable pump to be quite efficient and the Roots blower to be quite inefficient.

I claim:

1. A mechanical positive rotary pump in which all parts move in exact and precise orbits at all operational speeds and pressures, having a first housing member with a rotor mounted for rotation, with the rotor and the first housing member sharing a common planar face, and mating in a sealing manner with a second housing member, also with a planar face, which has a cavity which is approximately annular in shape and which, when mating with the first housing member, forms an enclosed chamber bounded by the first housing member with a rotor planar wall, and by the second housing member, having an axially inner arcuate surface boundary, an axially outer arcuate surface boundary, and a planar end surface boundary, which is parallel to the first housing planar surface; and having abutments which extend across the chamber and seal on all chamber surfaces, inner arcuate surface, outer arcuate surface, and planar surfaces and the abutments being the only members which seal and divide the chambers into sub-chambers, the abutments being positively held both by the surfaces of the chamber and by connections to the rotor face, and which connections neither divide nor seal the chamber, but serve to drive the abutments around the chamber; and the abutments requiring neither additional springs, centrifugal force, or pressure forces to seal the chamber, and such that the pressure forces pass through the center of the abutment in approximately the torque direction by fluid pressure, so that the abutments are not fluid pressure loaded to either arcuate surface, but the pressure is delivered to the abutment connection as torque; and the second housing member having an intake port entering axially into the center hub described by the axially inner arcuate surface, and whereupon the intake duct is curved so as to direct the intake fluid radially outward through an intake port though the axially inner arcuate surface into the chamber, and such that at all times the inner arcuate surface communicates freely, and without obstruction, with the outer axially arcuate surface which has a discharge port exiting tangentially from the chamber, by the diminishing volumes of the sub-chambers as well as by momentum so that, in the absence of excessive head pressure, the fluid within the sub-chamber exits tangentially by both means, such that as a cycle, fluid is drawn in through the intake chamber into the sub-chambers, where it is contained and displaced to the discharge port, where the fluid exits by both the diminishing of sub-chamber size and by momentum, since the abutments divide the chamber into sub-chambers, which, during rotation, may change their volumes such that the maximum sub-chamber volume minus the minimum sub-chamber volume is the sub-chamber displacement, but the remaining volume is acted on by centrifugal force and momentum to provide a pumping component which is dependent on rotational velocity, which I shall refer to as a positive displacement tangential kinetic pump component.

2. A motor as in claim 1 in which the fluid enters the tangential axially outer port with both pressure and velocity and enters the sub-chambers, whereupon it is displaced around the chamber to the axially inner port, and generates torque to the rotor both through the force related to the expansible chamber, and also the torque acquired by the change in the angular momentum of the fluid associated with the difference between square of the initial velocity and the final velocity, the velocity being approximately divided by a factor of two, resulting in an energy of a factor of 2 squared or 4, such that the additional torque means additional power as well as efficiency of the motor.

3. A pump as in claim 1 in which the abutments are flexible members with axial projections extending into slot connections in the rotor planar face which orient the flexible vane-like abutments to extend radially across the chamber to positively engage both the inner and outer arcuate chamber surface as well as the planar walls so as to positively divide the chamber into sub-chambers at all times except when passing the ports, and the abutments having connections to the center of the abutments, the flexible portions extending, radially in both directions from the abutment projection, such that the chamber is divided into sub-chambers; and having an intake port through the axially inner arcuate surface of the second housing member, which always communicates with the axially outer arcuate chamber surface of the second housing member, such that fluid enters the sub-chambers radially, whereupon it fills the sub chambers and is displaced around the chamber where it is discharged by both the diminishing of the sub-chamber volume and by momentum through the tangential discharge port.

4. A pump as in claim 3 in which debris can be pumped through without damage, since the sub-chambers are open and unimpeded, and since the abutments can deform to pass solid matter entrained in the fluid.

5. A pump as in claim 3 in which the chamber is nearly annular in shape, such that the expansible chamber displacement is small and so that the pump at start up can self prime by pumping the air out by the small displacement, whereupon the pump becomes a high volume liquid tangential kinetic pump since the sub-chamber volume is large.

6. A pump as in claim 5 in which the chamber is very nearly annular, so that the expansible chamber displacement is minimal and the abutments are rigidly attached members, which may be rigid, which divide and seal the chambers with a small clearance, such that fluid enters the sub-chambers, is contained and transported to the tangential discharge port where it is discharged primarily by momentum.

7. A pump as in claim 1 in which the abutments are flexible members with rigid axially inside ends, the rigid ends being connected to the rotor face rigidly, and with the flexible members extending across the chamber so as to divide into sub-chambers and seal the sub-chamber on all sides, and both the first housing member and the second housing member each having a groove in the planar surface at the junction with the axially outer planar surface, and the abutments having land projections that fit the grooves such that, although the abutments are flexible, they always divide the chamber, being contained on either abutment radial end, so as to provide expansible sub-chambers as well as being positively contained chambers which discharge the fluid by momentum.

8. A pump as in claim 7 in which the chamber is nearly annular in shape, and the expansible chamber displacement is small, such that the pump can be a self-priming expansible chamber pump but is primarily a positive displacement tangential kinetic pump.

9. A pump as in claim 1 in which the chamber in the second housing member is an annular groove, and both housing members have planar faces, including the flanges, so that the axis of the second housing member may be shifted linearly from the first housing member, and having abutments which are rigid elements which extend across, seal and divide the chamber into sub chambers by sealing on every chamber surface including axially inner arcuate surface, outer arcuate surface, and planar walls of the second housing member, being the only members which seal the chamber; and the abutments seal the chamber on radial planes passing though the axis of the second housing member, such that pressure in the chamber is directed normal to the abutment face and through the center of the abutment which engages rotor connection projections extending from the rotor planar face which neither divide the chamber nor seal, providing a variable displacement and expansible chamber positive displacement tangential kinetic pump.

10. A pump as in claim 9 in which the abutments have a specific gravity near to, or lower than the specific gravity of the fluid, such that the centrifugal force acts on the fluid to force the abutment away from the axially outer arcuate chamber high speed surface and toward the chamber axis.

11. A pump as in claim 9, which at either lower rotational speeds or at higher head pressures pumps primarily by the force of the changing volumes of the contained sub-chambers.

12. A pump as in claim 9, when operating at higher rotational speeds and lower head pressures, pumps primarily by the momentum of the fluid leaving the sub-chambers tangentially.

13. A pump as in claim 9 in which the variable displacement and the rotational speed maybe set so as to provide a self priming pump in which as the operational speed is attained, the pumping function changes from primarily expansible chamber pumping to momentum pumping at high capacity, and then as head pressure is increased the momentum pumping decreases and then a further head pressure increase, pumping again becomes a function of expansible chambers; such that a curve of head pressures vs. capacity is roughly hyperbolic, and results in a fairly constant drive motor torque over a wide range of head pressures and flow rates.

14. A pump as in claim 9 in which the abutments have parallel sliding surfaces mating in tolerance contact with both the inner and outer arcuate chamber surface as well as the planar surface, and having an arcuate surface on either radial surface, which pivots the abutment as well as allowing it to slide in radial slots in a rotor connection projection such that all abutment sealing surfaces are parallel sliding surfaces, and such that the pressure forces can pass in a normal direction to the rotor projection slot, and thus putting the load in the torque direction, and with the abutments having radial slots to facilitate the communication of the fluid from the axially inner arcuate surface to the axially outer arcuate surface, being especially valuable for the kinetic pumping aspect, and such that the abutments can be tailored to pressure balance radially in order to reduce any radial pressure, which will cause wear from pressured sliding surfaces, by varying the radially inside exposed area to the outside radially exposed area on the arcuate broad surfaces.

15. A pump as in claim 9 in which the abutments are sliding vanes having parallel sliding radial surfaces, and arcuate end surfaces, and the end surfaces have an arc of the diameter of the radial chamber width, and the vanes having such thickness as to have the sealing contact surface on the arcuate ends always be on a plane passing radially outward from the axis of the second housing member; and having rotor drive connections which are projections from the planar rotor face which have radial slots to accept the vanes and to drive them around the chamber but not to seal the chamber so that the radial vanes are the only members which divide and seal the chamber, forming sub-chambers, and the vanes having the pressure force directed through the vane center, approximately normal to the radial slot, and having very little force component bearing on either the inner arcuate or the outer arcuate surface, and, such that the sub-chambers have greater volume than the sub-chamber displacement, so that the residual volume may be ejected by momentum.

16. A pump as in claim 9 having sliding vane abutments with parallel sliding surfaces, and arcuate ends, and having rotor connections that are projections which have radial slots of a width equal to multiple abutment thickness, and having multiple abutments in each slot, providing multiple seals, such that the vanes seal and divide the chamber seal and divide the chamber into sub chambers.

17. A vacuum pump as in claim 9 in which the abutments have hinged parallel sliding surfaces on all sides and which are the only members which divide and seal the chamber, and which have radial slots in which rotor connection projections engage, which drive the abutments around the annular chamber; and such that the abutments have tolerance sealing on all surfaces except the axial inner arcuate surface, which has parallel sliding surface sealing, and the intake port being through the center axis of the second housing member through the axially inside arcuate surface and through rotary valving ports in each abutment hinge, to allow the gas to enter the sub-chambers, and the gas entering the sub-chambers is compressed and is displaced angularly around the chamber to the discharge port which, because this is a pneumatic device, is discharged through any chamber surface of housing member 2 except the center hub, forming an expansible vacuum pump which has variable compression and which has very little kinetic component in pumping, due to the low specific gravity of the fluid, but the variable displacement allows a near constant operating torque over a wide vacuum pressure range, when the displacement is controlled by, or linked to, the pressure or rotational speed.

18. A pump or motor as in claim 9 in which the abutments are cylindrical rollers, which are contained in radial slots in projections extending from the rotor face, and such that the roller abutments are the only elements which seal and divide the chamber into sub-chambers, and the abutment rollers provide pressure loading to the radial slot in a normal or nearly normal direction, so that the pressure forces are directed against the radial slots in the torque direction and such that the abutments have little or no force component against the arcuate high speed chamber surfaces, and as a motor, the roller abutments, when touching the arcuate high speed surface, tend to be moved away from the surface, rather than toward the surface.

19. A pump as in claim 9 in which the abutments are composite rollers, having a central cylindrical roller and another roller on each side, and the three roller elements are pivoted on a common shaft through the roller cylindrical axis; and the center roller being incrementally larger in diameter, and the rollers contained in radial slots in the drive projections extending from the rotor face such that only the center roller element engages the drive connection projection slot, and the drive projection slot is incrementally relieved so that the two side rollers never touch the drive projection slot, and the chamber arcuate surfaces are incrementally relieved in order that the center drive roller never touches the arcuate chamber surfaces, and the composite elements always divide and are the only elements sealing the chamber, and that the arcuate chamber surfaces are incrementally relieved for the center roller element, such that the central element maintains a tolerance, but never a touching seal against the high speed arcuate surfaces, and such that the outer cylinder elements may acquire spin, but the spin not be transferred to the pressured surface, thus avoiding friction and wear, as normally associated with common roller pump design.

20. A motor as in claim 9 in which the fluid enters the axially outer chamber surface and exits through the axially inner chambers surface, such that torque is provided both by the expansible chamber and by the change in angular momentum, thus providing an increase in power and efficiency; and having variable displacement which, can control torque power output, or rotational speed, such that the displacement, hence power may be controlled by linking pressure or torque load or rotational speed to the displacement shift.

21. A pump as in claim 9 in which the displacement is set at zero, such that there is no expansible chamber component, because the sub-chambers do not change volume, but they do capture and displace the around the chamber to the discharge port, where it is discharged tangentially, having attained energy by being accelerated to rotor velocity, such that at high rotational speeds and lower head pressures, the sub-chambers are partially or totally discharged by momentum, resulting in a high capacity pump with pressures higher than normally associated with kinetic pumps, such as centrifugal pumps, due to the positive displacement aspect, which provides a high velocity discharge.

22. A pump as in claim 20 in which the abutments are vane-like, and are rigidly connected to the rotor planar face by bolts or welding, such as to provide fixed volume sub-chambers, similar to an external gear pump, in which the fluid enters each sub-chamber, is contained, and accelerated to rotor velocity and is displaced around the chamber to the discharge port, where it is discharged tangentially by momentum, leaving a vacuum, or partial vacuum, which is then again filled with fluid as the intake port is passed.

23. A pump as in claim 21 in which the intake port is angularly expanded, but leaving a sector of the axially inner chamber surface, such that the fluid is totally contained, if only briefly, prior to discharge, allowing the fluid to accelerate and thus gain energy.

* * * * *